US007841846B2

(12) United States Patent
Fujita et al.

(10) Patent No.: US 7,841,846 B2
(45) Date of Patent: Nov. 30, 2010

(54) VANE PUMP WITH IMPROVED INTERNAL PORT PLACEMENT

(75) Inventors: Tomoyuki Fujita, Kani (JP); Hiroshi Shiozaki, Kani (JP); Tomomi Noda, Kani (JP); Eishin Noguchi, Sagamihara (JP); Shinji Yakabe, Inagi (JP)

(73) Assignee: Kayaba Industry Co., Ltd, Tokyo (JP)

( * ) Notice: Subject to any disclaimer, the term of this patent is extended or adjusted under 35 U.S.C. 154(b) by 0 days.

(21) Appl. No.: 12/391,267

(22) Filed: Feb. 24, 2009

(65) Prior Publication Data

US 2009/0162230 A1 Jun. 25, 2009

Related U.S. Application Data

(63) Continuation of application No. 11/609,338, filed on Dec. 12, 2006, now abandoned.

(30) Foreign Application Priority Data

Dec. 13, 2005 (JP) ..... 2005-358941

(51) Int. Cl.
*F03C 2/00* (2006.01)
*F03C 4/00* (2006.01)
*F04C 2/00* (2006.01)

(52) U.S. Cl. ..... 418/133; 418/259; 418/268

(58) Field of Classification Search ..... 418/131–134, 418/259, 266–268
See application file for complete search history.

(56) References Cited

U.S. PATENT DOCUMENTS

| | | | | | |
|---|---|---|---|---|---|
| 2,642,802 | A | * | 6/1953 | Gardiner | 418/133 |
| 4,842,500 | A | * | 6/1989 | Fujie et al. | 418/133 |
| 5,201,878 | A | * | 4/1993 | Abe et al. | 418/133 |
| 6,082,983 | A | * | 7/2000 | Hayashi et al. | 418/133 |
| 6,234,776 | B1 | * | 5/2001 | Hayashi et al. | 418/133 |
| 6,648,620 | B2 | * | 11/2003 | Yamauchi et al. | 418/259 |

FOREIGN PATENT DOCUMENTS

| | | | | |
|---|---|---|---|---|
| JP | 62271982 | A | * 11/1987 | 418/133 |
| JP | 2004084565 | A | * 3/2004 | |

* cited by examiner

*Primary Examiner*—Theresa Trieu
(74) *Attorney, Agent, or Firm*—Hiroe + Associates; Taras P. Bemko

(57) ABSTRACT

A vane pump according to the present invention is characterized in that a position of a first suction port located in the forward rotation direction of a rotor is brought closer to a suction port than a position of a second suction port located in the backward rotation direction of the rotor with the suction port as reference by positioning a side plate in the state where the discharge port is brought close to a mounting portion.

8 Claims, 6 Drawing Sheets

(Prior Art)

VANE PUMP WITH IMPROVED INTERNAL PORT PLACEMENT

REFERENCE TO RELATED APPLICATION

This application is a continuation of and claims priority based on U.S. patent application Ser. No. 11/609,338, filed Dec. 12, 2006, now abandon and on Japanese Patent Application Serial Number 2005-358941, filed Dec. 13, 2005, the full contents of both of which are hereby incorporated by reference.

BACKGROUND OF THE INVENTION

The present invention relates to a vane pump and particularly to a vane pump whose suction efficiency and volume efficiency are improved.

FIGS. 11 and 12 show an outline of a vane pump 100 of the background art. FIG. 11 is a longitudinal sectional view of the vane pump 100. FIG. 12 is a view of a front housing in the state seen from the left side in FIG. 11. In a space surrounded by a front housing 101 and a rear housing 102, a side plate 103, a cam ring 104 and a rotor 105 are provided coaxially.

As shown in FIG. 12, a cam face 106 in the oval shape is formed on an inner face of the cam ring 104. Also, the rotor 105 is mounted to a rotating shaft 107 and arranged within the cam ring 104. A plurality of vanes 108 are provided at the rotor 105 so that they protrude in a radial manner from the outer circumferential face of the rotor 105. With rotation of the rotor 105, the tip ends of the vanes 108 are brought into sliding contact with the cam face 106.

A space between the outer circumferential face of the rotor 105 and the vane 108 as well as the cam face 106 is a pump chamber p. The pump chamber P is changed so that its volume is repeatedly expanded/contracted with the rotation of the rotor 105. And at positions matching the volume expansion process of the pump chamber P, suction ports 109, 110 are provided at the corresponding side plate 103 and a rear housing 102, while at positions matching the contraction process, discharge ports 111, 112 are provided at the corresponding side plate 103. Also, on the side of the rear housing 102 opposite to the discharge ports 111, 112, recesses, not shown, for preventing movement of the rotor 105 in the axial direction by discharge pressure are provided at positions opposite to the discharge ports 111, 112.

The suction ports 109, 110 are provided at the positions horizontally opposed to each other with the rotating shaft 107 interposed between them in FIG. 12, and the discharge ports 111, 112 are provided in a pair so that they are vertically opposed to each other with the rotating shaft 107 interposed between them. Also, a working fluid sucked in through an inlet port 113 is sucked into the pump chamber P from the two suction ports 109, 110 through a first branch passage 114 and a second branch passage 115 provided so that they are horizontally branched to two passages in the rear housing 102 arranged in the form to seal the front housing 101 as shown by a two-dotted chain line in FIG. 12.

However, in the vane pump 100 constructed as above, there is a phenomenon that the suction efficiency of the suction port 110 located in the forward rotation direction (arrow direction) of the rotor 105 becomes poor as compared with the suction efficiency of the suction port 109 located in the backward rotation direction of the rotor 105 with the inlet port 113 as a reference.

That is, since the vanes 108 of the rotor 105 rotate in the direction opposite to the working fluid flowing through the first branch passage 114, the suction port 109 can suck the working fluid efficiently, while since the vane 108 of the rotor 105 is rotated in the same direction as the direction where the working fluid in the second branch passage 115 flows, the working fluid flowing through the second branch passage 115 can not be guided into the suction port 110 favorably, and the suction efficiency of the suction port 110 is lowered. By this, particularly at high rotation, there are problems that the amount of the working fluid required for suction becomes larger than that of the working fluid pressed in on the suction port 110 side with poor suction efficiency, cavitations are caused by a negative pressure on the suction port 110 side, and vibration noises are generated.

Therefore, an invention to solve these problems is proposed in Patent Document 1. When features of the invention described in Patent Document 1 are described referring to FIG. 12, the length of the second branch passage 115 is made shorter than the length of the first branch passage 114 so as to reduce fluidity resistance of the second branch passage 115 so that the suction efficiency of the suction port 110 is improved.

[Patent Document 1] Japanese Patent Application Laid-Open No. HEI 8-74750

However, the invention described in Patent Document 1 has the following problems. That is, as shown in FIG. 12, the high-pressure discharge ports 111, 112 are located at positions away from a mounting portion 116 for mounting the rear housing 102 to the front housing 101. Therefore, the rear housing 102 is deformed so that it is separated from the front housing 101 by the pressure of the working fluid, on the axis passing through the high-pressure discharge ports 111, 112, and a clearance between the rear housing 102 and the rotor 105 as well as the vane 108 is widened. Thus, a leakage of the working fluid from the pump chamber P to another pump chamber P is generated through the clearance and as a result, there is a problem that the volume efficiency is deteriorated.

The present invention was made in order to solve the above-mentioned background art, and its object is to provide a hydraulic pump in which a favorable balance of a suction efficiency of two suction ports is ensured and the volume efficiency is improved.

A vane pump according to the present invention is characterized in that a side plate or a rear housing is positioned in the state where a discharge port is brought close to a mounting portion so that a position of a first suction port located in the forward rotation direction of the rotor is brought closer to a suction port than a position of a second suction port located in the backward rotation direction of the rotor with the suction port as reference.

Since a balance between the suction efficiency of the first suction port located in the forward rotation direction of the rotor and the suction efficiency of the second suction port located in the backward rotation direction of the rotor can be maintained and moreover, the discharge port can be provided in the vicinity of the mounting portion for the front housing and the rear housing, the phenomenon that the rear housing 102 is deformed so as to be separated from the front housing 101 by a pressure of the high-pressure working fluid acting on the discharge port is prevented, and a clearance between the rear housing and the rotor as well as the vane is prevented from being widened. As a result, a leakage of the working fluid from the pump chamber to another pump chamber through the clearance is prevented, and the volume efficiency can be improved.

DETAILED DESCRIPTION OF EXAMPLE EMBODIMENTS

Figure 1:
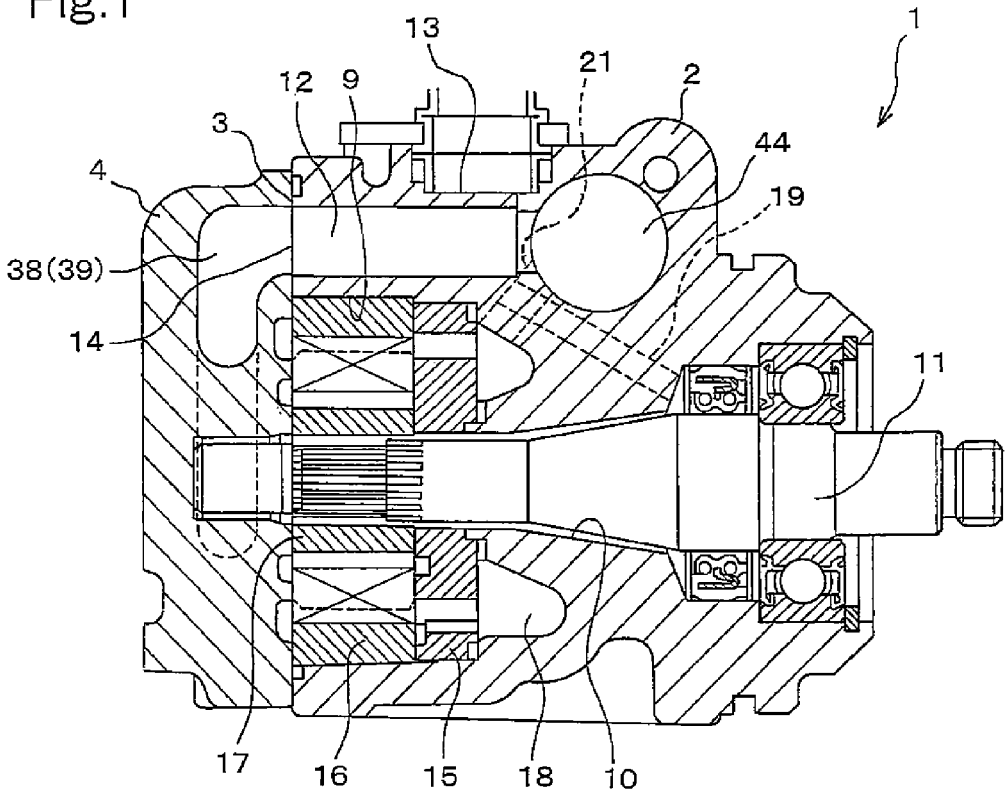
FIG. 1 A longitudinal sectional view of a vane pump.
Figure 2:
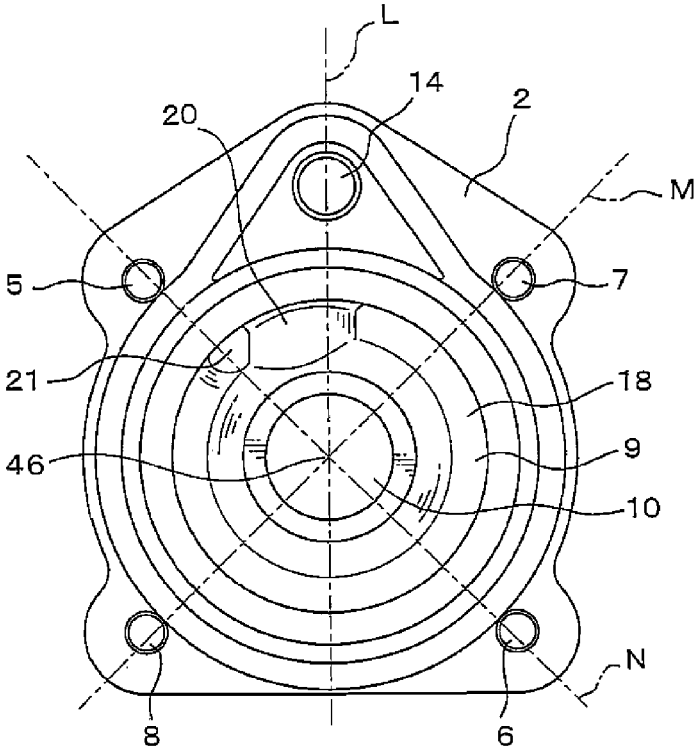
FIG. 2 A front view of a front housing in the state seen from the left side in FIG. 1.
Figure 3:
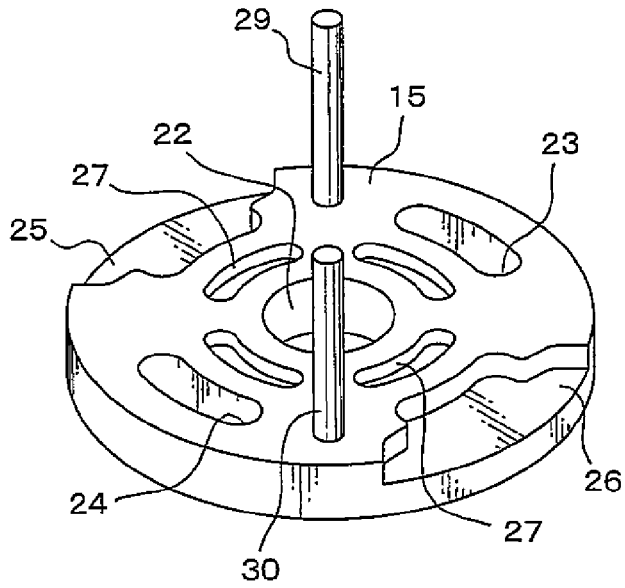
FIG. 3 A perspective view of a side plate.
Figure 4:
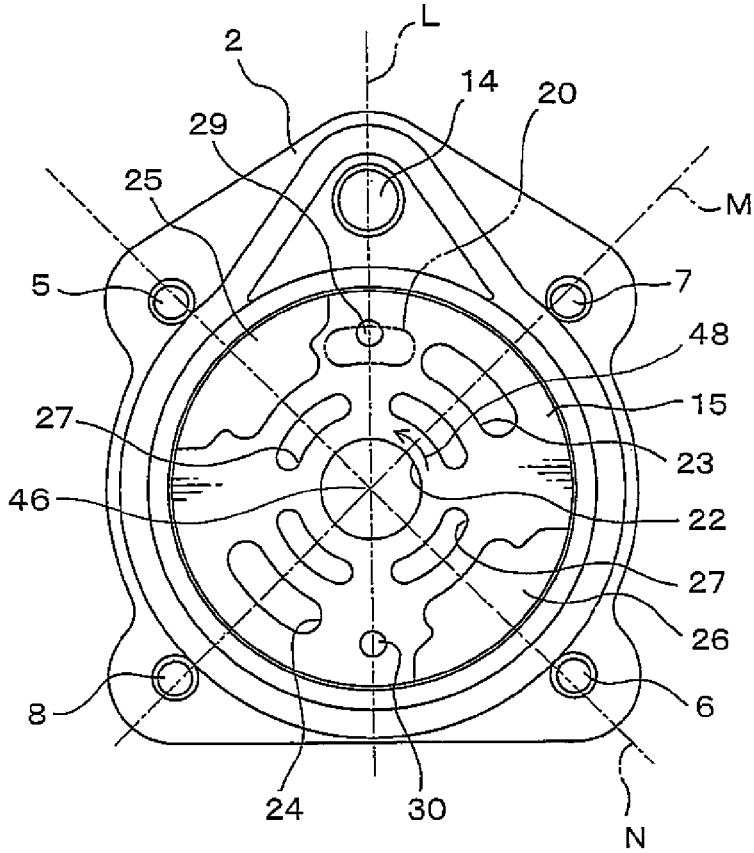
FIG. 4 A view of a state where the side plate is installed in the front housing.
Figure 5:
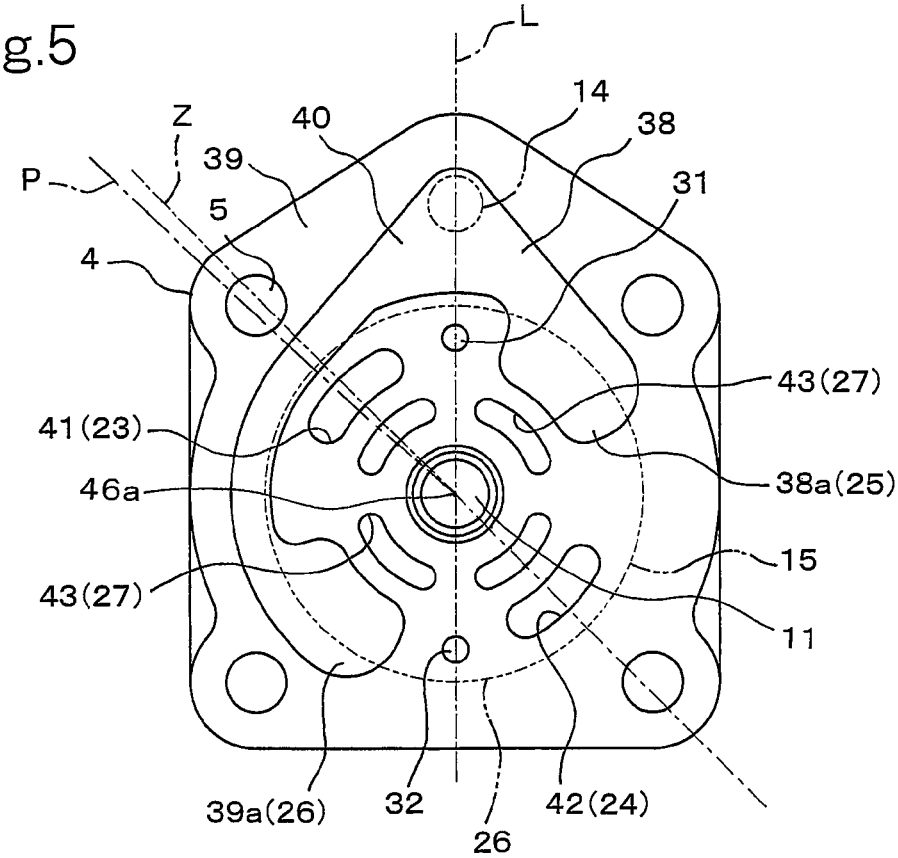
FIG. 5 A front view of a rear housing.
Figure 6:
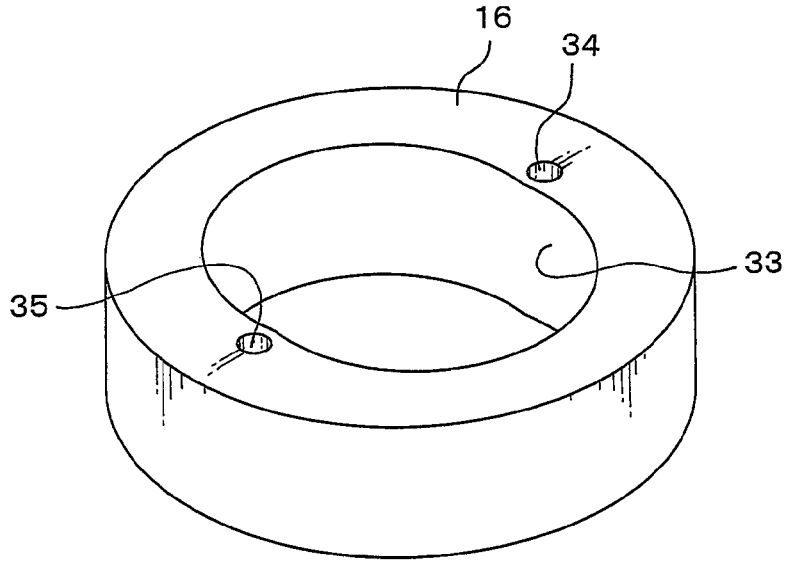
FIG. 6 A perspective view of a cam ring.
Figure 7:
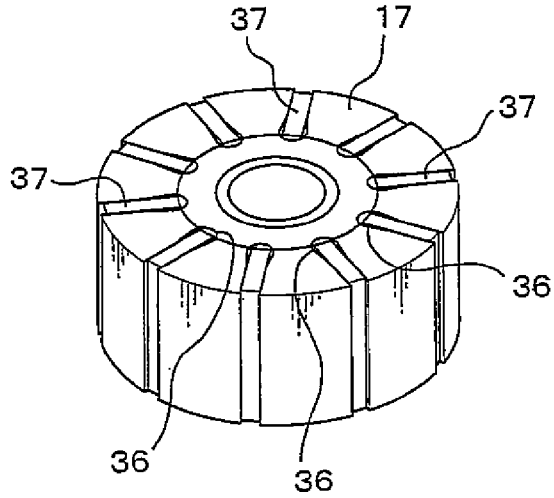
FIG. 7 A perspective view of a rotor.
Figure 8:
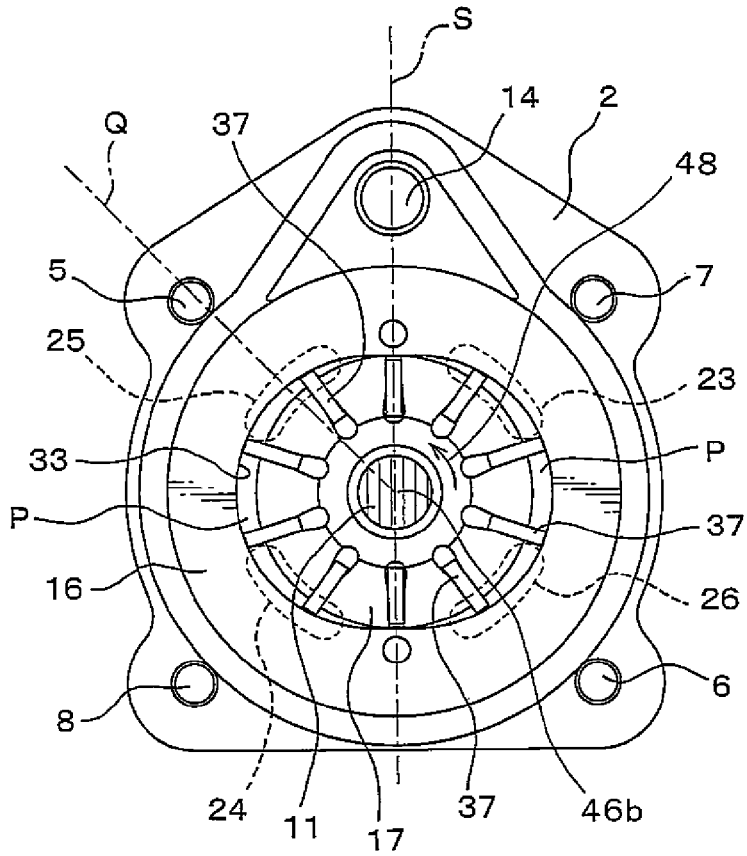
FIG. 8 A view of a state where the side plate, the cam ring and the rotor are installed in the front housing.

FIG. 1 is a longitudinal sectional view of a vane pump. FIG. 2 is a view of a front housing in the state seen from the left side in FIG. 1. FIG. 3 is a perspective view of a side plate. FIG. 4 is a view in the state where the side plate is placed within a front housing shown in FIG. 2. FIG. 5 is a front view of a rear housing. FIG. 6 is a perspective view of a cam ring. FIG. 7 is a perspective view of a rotor. FIG. 8 is a view showing a state where the side plate, the cam ring and the rotor are placed within the front housing.

As shown in FIG. 1, the vane pump 1 comprises a front housing 2 and a rear housing 4 mounted on one face 3 of the front housing 2. As shown in FIG. 2, the rear housing 4 is mounted to the front housing 2 by two pairs of mounting portions 5, 6, 7, 8. As shown in the same FIG. 2, each of the pairs of mounting portions 5, 6, 7, 8 is provided at four corners so that they are opposed to each other in the diagonal direction.

The front housing 2 has a space 9. The space 9 is constructed so that one face 3 side of the front housing 2 is opened and the other face side is closed, and a shaft hole 10 is formed on the other face so that a rotating shaft 11 is inserted into the space 9 from the shaft hole 10. Also, as shown in FIG. 1, an inflow passage 12 is formed in the front housing 2. The upstream end of this inflow passage 12 is a communication port 13 capable of being connected to an oil tank (not shown), while the downstream end is a suction port 14 and opened in the one face 3 of the front housing 2.

As shown in FIG. 1, in the space 9, a side plate 15, a cam ring 16 and a rotor 17 are placed coaxially. A space between the side plate 15 and the front housing 2 is a pressure chamber 18. As shown in the same FIG. 1, a drain passage 19 (shown by a dotted line in FIG. 1) is formed inside the bottom face of the pressure chamber 18. The drain passage 19 is a passage for returning the working fluid internally leaking to the side of a seal member of the rotating shaft 11 due to a clearance and the like at each portion to the communication passage 12 on the low pressure side. And in order to form the drain passage 19, as shown in FIG. 2, the bottom face of the pressure chamber 18 is protruded so as to expand as a built-up portion 20 into the pressure chamber 18. Also, in the pressure chamber 18, a discharge hole 21 is formed at a position avoiding the built-up portion 20 so as to discharge the working fluid brought into a high pressure in the pressure chamber 18 through the discharge hole 21. Moreover, as shown in FIG. 2, a line N connecting a pair of the mounting portion 5 and the mounting portion 6 opposed to each other having the shaft hole 10 interposed between them and a line M connecting a pair of the mounting portion 7 and the mounting portion 8 opposed to each other having the shaft hole 10 interposed between them are provided so as to form an angle, having its vertex 46 at the intersection of lines L, M, and N, of about 45 degrees with respect to a line L connecting the shaft hole 10 and the suction port 14. These lines M and N are crossed with each other at right angles.

As shown in FIG. 3, the side plate 15 is formed in a disk state. At the center of the side plate 15, a center hole 22 through which the rotating shaft 11 penetrates is formed. Also, in the side plate 15, a first discharge port 23 as well as a second discharge port 24 and a first suction port 25 and a second suction port 26 are provided. Here, as shown in FIG. 4, the first suction port 25 is a port located in the forward rotation direction (arrow direction 48 in FIG. 4) of the rotor 17 with reference to the suction port 14 formed in the front housing 2, and the second suction port 26 is a port located in the backward rotation direction of the rotor 17 with reference to the suction port 14. As shown in FIG. 4, the first discharge port 23 and the second discharge port 24 are provided at positions opposite to each other having the center hole 22 of the side plate 15 interposed between them, and the first suction port 25 and the second suction port 26 are provided at positions opposite to each other having the center hole 22 interposed between them. The first discharge port 23 and the second discharge port 24 are located on the above-mentioned line M. Also, the first suction port 25 and the second suction port 26 are located on the above-mentioned line N.

Moreover, as shown in FIGS. 3 and 4, in the side plate 15, a plurality of back-pressure grooves 27 are formed coaxially with the center hole 22. These back-pressure grooves 27 communicate with the above pressure chamber 18 (shown in FIG. 1). In the side plate 15, two mounting pins 29, 30 are installed upright. These two mounting pins 29, 30 are formed at positions opposite to each other having the center hole 22 interposed between them. Corresponding to the positions of these two mounting pins 29, 30, as shown in FIG. 5, pin holes 31, 32 are formed in the rear housing 4. By inserting tip ends of the mounting pins 29, 30 through the pin holes 31, 32 of the rear housing 4, the side plate 15 is positioned.

The side plate 15 can be installed in the state where it is rotated by a desired angle within the space 9 of the front housing 2 as shown in FIG. 4. And in this case, according to the installed angle of the side plate 15, as shown in FIG. 5, the positions of the pin holes 31, 32 provided in the rear housing 4 are determined. In this way, by determining the positions of the pin holes 31, 32 provided in the rear housing 4 according to the installed angle of the side plate 15, the side plate 15 is positioned by the rear housing 4 at the desired installed angle.

The cam ring 16 is, as shown in FIG. 6, formed in the annular state, and the inner face is a cam face 33 in an oval shape. In the cam ring 16, pin holes 34, 35 through which the mounting pins 29, 30 are inserted are formed.

The rotor 17 is, as shown in FIG. 8, housed in the cam ring 16 and mounted on the rotating shaft 11. In the rotor 17, as shown in FIG. 7, a plurality of vane housing grooves 36 are provided in the radial state and in each of the vane housing grooves 36, a vane 37 is provided capable of going in/out. The base end side of the vane housing grooves 36 communicates with the pressure chamber 18 of the front housing 2 through the back-pressure grooves 27 provided in the side plate 15 and urges the vanes 37 in the direction protruding from the vane housing grooves 36 by the pressure in the pressure chamber 18.

Therefore, as shown in FIG. 8, with rotation of the rotor 17, the tip ends of the vanes 37 are brought into sliding contact with the cam face 33 of the cam ring 16, and a pump chamber P surrounded by the outer circumferential face of the rotor 17 and the vanes 37 as well as the cam face 33 is formed.

The pump chamber P is varied with the rotation of the rotor 17, the volume thereof repeating expansion and contraction. And in the side plate 15, the first suction port 25 and the second suction port 26 are provided at the positions matching the expansion process of the pump chamber P, while the first discharge port 23 and the second discharge port 24 are provided at the positions matching the contraction process.

As shown in FIG. 5, in the rear housing 4, a suction passage is formed for sucking the working fluid through the inlet port 14 (shown by a two-dotted chain line in FIG. 5) of the front housing 2. The suction passage is branched in the bifurcated state into a first branch suction passage 38 and a second branch suction passage 39. In the state where the rear housing 4 is mounted to the front housing 2, a branch portion 40 of the suction passage is opposed to the inlet port 14 of the front housing 2 (shown by the two-dotted chain line in FIG. 5), while a terminal portion 38*a* of the first branch suction passage 38 is opposed to the first suction port 25 of the side plate 15 (shown by a two-dotted chain line in FIG. 5) and a terminal portion 39*a* of the second branch suction passage 39 is opposed to the second suction port 26 of the side plate 15. Also, as shown in FIG. 5, in the rear housing 4, a first discharge-port-corresponding recess portion 41 is formed corresponding to the first discharge port 23 of the side plate 15 (shown by the two-dotted chain line in FIG. 5), a second discharge-port-corresponding recess portion 42 is formed corresponding to the second discharge port 24, and moreover, a back-pressure groove corresponding recess portion 43 is formed corresponding to the back-pressure groove 27 of the side plate 15. In FIG. 1, reference numeral 44 denotes a flow-rate regulating valve. The flow-rate regulating valve 44 is provided between the communication passage 12 and the pressure chamber 18 for controlling the flow rate discharged from the discharge port 21, not shown, in the flow rate of the high-pressure working fluid discharged from the discharge port 21 of the pressure chamber 18 and returning excess working fluid to the inflow passage 12.

Next, action will be described. As compared with the background arts, as shown in FIG. 4, with the inlet port 14 as reference, the first suction port 25 located in the forward rotation direction (arrow direction 48 in FIG. 4) of the rotor 17 is located close to the inlet port 14, while the second suction port 26 located in the backward rotation direction of the rotor 17 is located far away from the inlet port 14.

As a result, as shown in FIG. 5, the first branch suction passage 38 becomes shorter than the second branch suction passage 39, and the flow passage resistance of the first branch suction passage 38 is decreased as compared with that of the second branch suction passage 39. Thus, the suction efficiency from the first suction port 25 is improved, and the balance in suction efficiency between the first suction port 25 and the second suction port 26 can be made better. Also, since the suction efficiency on the first suction port 25 side is improved, a phenomenon that a negative pressure is generated particularly at high rotation in the first suction port 25 can be suppressed and as a result, generation of cavitations on the first suction port 25 side can be restricted and moreover, generation of vibration noise can be restrained.

Also, as compared with the background arts, as shown in FIG. 4, since the first discharge port 23 is brought close to the mounting portion 7 and the second discharge port 24 to the mounting portion 8, in the vicinity of the first discharge port 23 and the second discharge port 24, the rear housing 4 is maintained in the state firmly mounted to the front housing 2. As a result, even if the high-pressure working fluid acts on the first discharge port 23 and the second discharge port 24, the rear housing 4 is difficult to be separated from the front housing 2, and a clearance is hardly generated between the both. As a result, the clearance between the rear housing 4 and the rotor 17 as well as the vane 37 is prevented from being widened and leakage of the working fluid from the pump chamber P to another pump chamber P through the clearance is prevented. Therefore, as compared with the background arts, there is a working effect that volume efficiency can be improved.

Also, as shown in FIG. 4, since the first discharge port 23 is located avoiding the built-up portion 20 (shown by the two-dotted chain line in FIG. 4) of the drain passage 19 (shown in FIG. 1), the high-pressure working fluid can be discharged from the discharge hole 21 efficiently.

Moreover, as shown in FIG. 5, since the pin holes 31, 32 provided in the rear housing 4 can be formed at positions with a wide space avoiding the two branch suction passages 38, 39, the pin holes 31, 32 can be formed in the round shape as compared with the background arts and the mounting pins 29, 30 shown in FIGS. 3 and 4 can be stably inserted through the pin holes 31, 32, vibration of the cam ring 16 through which the mounting pins 29, 30 are inserted can be kept small and vibration noise can be suppressed.

Figure 9:
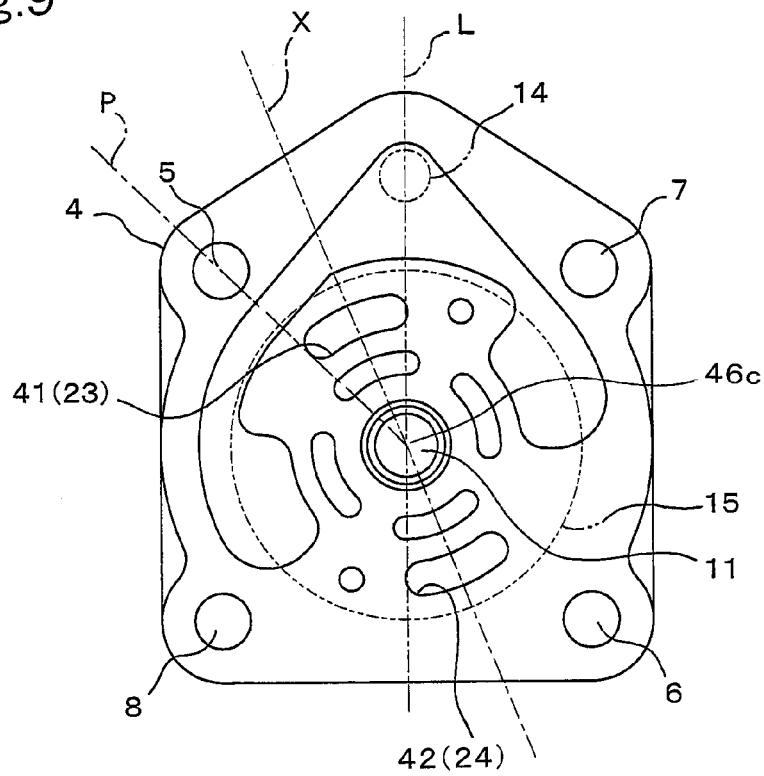
FIG. 9 A front view of the rear housing when the installing angle of the side plate is changed.
Figure 10:
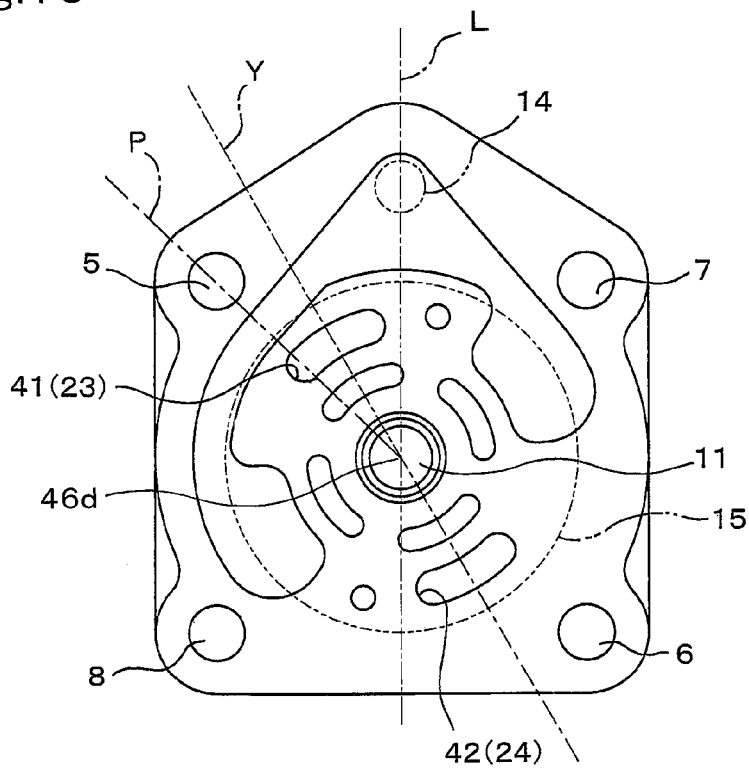
FIG. 10 A front view of the rear housing when the installing angle of the side plate is changed.
Figure 11:
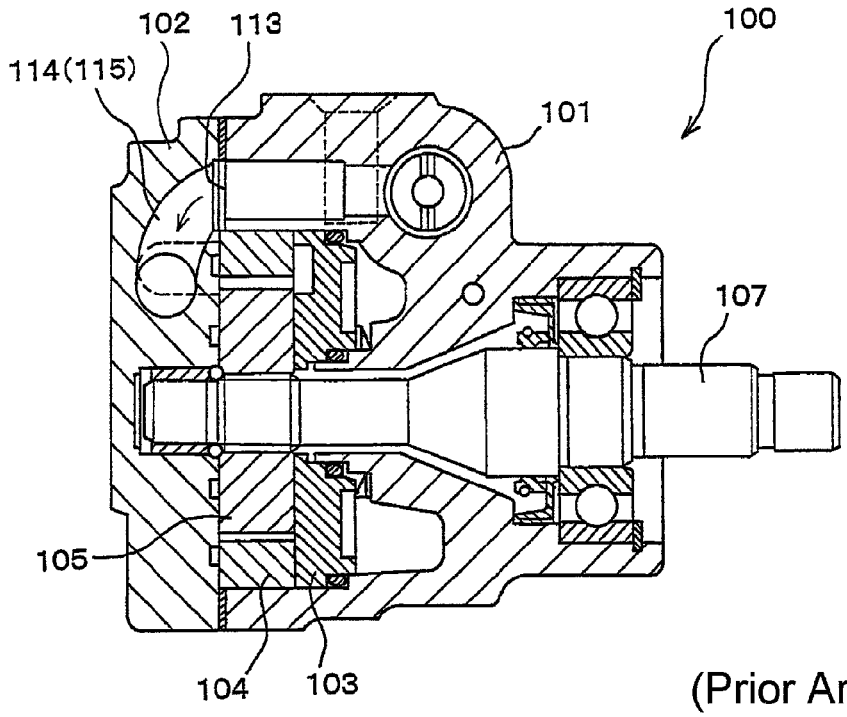
FIG. 11 A longitudinal sectional view of a vane pump of the background art.
Figure 12:
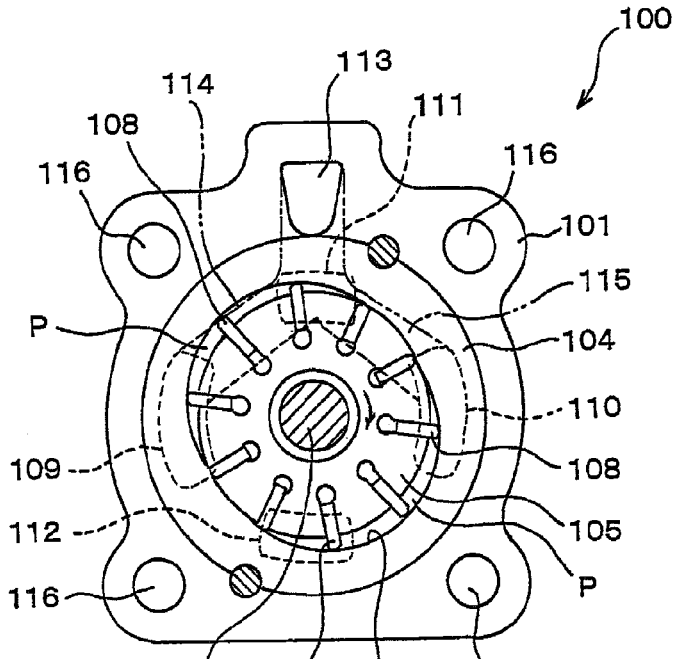
(Prior Art) Fig.12
FIG. 12 A front view of a front housing in a state where a side plate, a cam ring and a rotor are installed in the front housing of the background art.

FIG. 5 shows the state where the side plate 15 is rotated and installed so that a straight line Z connecting the shaft center of the rotating shaft 11 to the first discharge port 23 and the second discharge port 24 forms an angle, having its vertex 46*a* at the intersection of lines L and Z, of about 45 degrees with the reference line L connecting the shaft center of the rotating shaft 11 and the inlet port 14. FIG. 5 further illustrates a preferred relationship between the discharge ports 23, 24 and the mounting portion 5. It should be appreciated, by those skilled in the art that the relationship, described herein, regarding mounting portion 5 and the discharge ports 23, 24 can be applied similarly with the other mounting portions 6, 7, and 8 and should not be viewed as a limitation herein. In at least one embodiment the discharge port 23 is positioned so that an imaginary line P passing substantially through the center of discharge port 23 forms a very small angle at the vertex 46*a* of imaginary line P and imaginary line Z described hereinabove. This angle preferably can vary from zero (0°) degrees up to but less than forty-five (45°) degrees. It should be appreciated that if the angle of forty-five (45°) degrees were to be employed then the vane pump, described herein, would not have advantages over the conventional vane pumps. However, if the angle is less than forty-five degrees, then the herein described advantages are attained. Further, FIGS. 9 and 10 illustrate other preferred embodiments where the angle between line P and line X (FIG. 9) or line Y (FIG. 10), at its vertex 46*c* (FIG. 9) or its vertex 46*d* (FIG. 10) varies between zero (0°) degrees and up to but less than forty-five (45°) degrees. Although every conceivable angle for every conceivable embodiment is not illustrated herein, those skilled in the art can readily appreciate that the range of preferred angles is disclosed herein as the side plate 15 is rotatable to a variety of position. FIG. 9 shows the state where the side plate 15 is rotated and installed so that a straight line X connecting the shaft center of the rotating shaft 11 to the first discharge port 23 and the second discharge port 24 forms an angle, having its vertex 46*c* at the intersection of lines L and X, of about 22.5 degrees with the reference line L connecting the shaft center of the rotating shaft 11 and the inlet port 14.

Also, FIG. 10 shows the state where the side plate 15 is rotated and installed so that a straight line Y connecting the shaft center of the rotating shaft 11 to the first discharge port 23 and the second discharge port 24 forms an angle, having its vertex 46*d* at the intersection of lines L and Y, of about 30 degrees with the reference line L connecting the shaft center of the rotating shaft 11 and the suction port 14.

It is needless to say that a balance of the suction efficiency between the first suction port 25 and the second suction port 26 can be improved in the embodiments shown in FIGS. 9 and 10. Also, as compared with the background arts, since the first discharge port 23 is brought closer to the mounting portion 5 and the second discharge port 24 to the mounting portion 6, even if the high-pressure working fluid acts on the first discharge port 23 and the second discharge port 24, the rear housing 4 is hard to be separated from the front housing 2, and a clearance is hardly generated between the both. Therefore, since a clearance between the rear housing 4 and the rotor 7 as well as the vanes 37 is prevented from being widened and as a result, leakage of the working fluid from the pump chamber P to another pump chamber P through the clearance is prevented, and such a working effect that the volume efficiency can be improved as compared with the background arts can be obtained.

In the above description, an example was described that the pressure chamber 18 is provided on the front housing 2 side, but the present invention can be applied to the case that the pressure chamber 18 is provided on the rear housing 4 side. Also, the present invention can be applied even if the discharge ports 23, 24 and the suction ports 25, 26 are provided on at least either of the side plate 15 or the rear housing 4.

Also, in the above description, an example was described that the mounting pins 29, 30 are set up on the side plate 15, but the present invention can be also applied to the case that the mounting pins 29, 30 are installed upright on the rear housing 4, while pin holes are provided in the cam ring 16 and the side plate 15 so that the rear housing 4 and the side plate 15 are positioned by inserting the mounting pins 29, 30 into the pin holes.

What is claimed is:

1. A vane pump comprising:

a rotor;

a front housing;

a rear housing, wherein the rotor is located in a space formed between the front housing and the rear housing, and wherein the rear housing is secured to the front housing at at least two mounting portions;

structure defining an inlet port in the front housing;

structure configured to deliver a working fluid from the inlet port into a pump chamber in which the working fluid is pumped by rotation of the rotor, wherein the fluid delivery structure includes at least two suction ports, and wherein the working fluid is drawn in from the inlet port, which is installed on the front housing, and is drawn from the at least two suction ports into the pump chamber, and wherein the at least two suction ports are positioned so that a center of a first one of the at least two suction ports is closer, in a direction opposite of the rotor's rotation, to a center of the inlet port than a center of a second one of the at least two suction ports, in a direction of the rotor's rotation, and structure configured to discharge the working fluid from the pump chamber, wherein the working fluid discharge structure includes at least two discharge ports positioned so that at least one of the at least two discharge ports is radially proximate to one of the at least two mounting positions.

2. The vane pump of claim 1, wherein a first imaginary line through the center of the first one of the at least two discharge ports and the rotor's center of rotation, and a second imaginary line through a center of the inlet port and the rotor's center of rotation, of less than 45 degrees with the angle's vertex at the rotor's center of rotation.

3. The vane pump of claim 1, wherein an angle between a first imaginary line through the center of the first one of the at least two discharge ports and the rotor's center of rotation and a second imaginary line through the center of the inlet port and the rotor's center of rotation is substantially 22.5 degrees with the angle's vertex at the rotor's center of rotation.

4. The vane pump of claim 1, wherein an angle between a first imaginary line through the center of the first one of the at least two discharge ports and the rotor's center of rotation and a second imaginary line through the center of the inlet port and the rotor's center of rotation is substantially 30 degrees with the angle's vertex at the rotor's center of rotation.

5. The vane pump of claim 1, wherein both of the first and second discharge ports are substantially symmetrically disposed about the rotor.

6. A vane pump comprising:

a rotor;

a front housing;

structure defining an inlet port in the front housing;

a rear housing, wherein the rotor is located in a space formed between the front housing and the rear housing, and wherein the rear housing is secured to the front housing at least two mounting portions, wherein the at least two mounting portions include a first and a second mounting portion that are the two mounting portions closest to the inlet port;

structure configured to deliver a working fluid from the inlet port into a pump chamber in which the working fluid is pumped by rotation of the rotor, wherein the fluid delivery structure includes at least two suction ports each positioned so that a center of a first one of the at least two suction ports is closer, in a direction opposite of the rotor's rotation, to a center of the inlet port than a center of a second one of the at least two suction ports, in a direction of the rotor's rotation; and structure configured to discharge the working fluid from the pump chamber, wherein the working fluid discharge structure includes at least two discharge ports positioned so as having a first of the at least two discharge ports and the first of the first and second mounting portions closer to each other than the first discharge port and the second mounting portion.

7. The vane pump of claim 6, wherein at least a first of the first and second discharge ports lies along an imaginary line through the first mounting portion and a center of the rotor's rotation.

8. The vane pump of claim 7, wherein both of the first and second discharge ports lie along the imaginary line through the first mounting portion and the center of the rotor's rotation with the rotor disposed between the first and second discharge ports.

* * * * *